United States Patent [19]

Eloranta et al.

[11] 3,985,994

[45] Oct. 12, 1976

[54] DRAIN PIPE STERILIZATION

[75] Inventors: Kalevi Eloranta; Raimo Lindroos, both of Rauma; Jorma Surakka, Savonlinna, all of Finland

[73] Assignee: K. Oras Oy, Rauma, Finland

[22] Filed: Dec. 2, 1974

[21] Appl. No.: 526,524

[30] Foreign Application Priority Data

Nov. 26, 1973 Finland ..... 3642/73

[52] U.S. Cl. ..... 219/201; 4/206; 21/2; 134/19; 138/33; 219/301; 219/535

[51] Int. Cl.[2] ..... H05B 1/00; E03C 1/28; A61L 1/00

[58] Field of Search ..... 219/280, 281, 301, 296, 219/302, 535, 311; 4/255, 191, 207, 206; 134/5, 19; 21/2, 54 R, 61; 138/33

[56] References Cited

UNITED STATES PATENTS

| | | | |
|---|---|---|---|
| 1,913,099 | 6/1933 | Ballentine | 219/311 X |
| 2,452,367 | 10/1948 | Gangloff | 219/535 X |
| 2,582,103 | 1/1952 | Clegg | 219/311 |
| 2,593,459 | 4/1952 | Johnson | 219/535 X |
| 3,579,662 | 5/1971 | Lowry et al. | 219/535 UX |

FOREIGN PATENTS OR APPLICATIONS

| | | | |
|---|---|---|---|
| 1,316,098 | 5/1973 | United Kingdom | 219/535 |

*Primary Examiner*—A. Bartis
*Attorney, Agent, or Firm*—Kurt Kelman

[57] ABSTRACT

The connecting pipe portion between the outlet pipe and the drain pipe of a wash basin is surrounded by an electric heater for heating the interior of the connecting pipe portion to a temperature of about 80° to 100°C to prevent microbes from rising from the drain pipe into the outlet pipe. The connecting pipe portion comprises a metal ring having a heating coil wound thereon and being thermally insulated from the outlet pipe and drain pipe by insulating rings. The outlet pipe may include a conical stub pipe projecting into the ring and spaced therefrom by an air gap.

5 Claims, 1 Drawing Figure

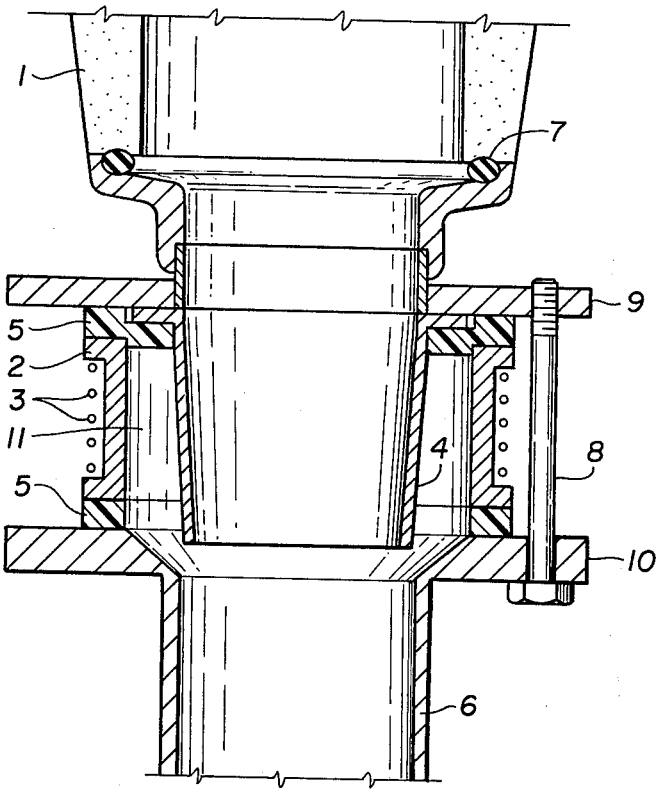
1
7
9
5
2
3
11
4
8
5
10
6

DRAIN PIPE STERILIZATION

This invention relates to a wash basin and the like, and more particularly to means for sterilizing the drain pipe thereof.

British Pat. No. 1,316,098 discloses a waste water trap in and for a sink or the like, which is provided with means for heating the water in the trap to sterilize the same. In this way, microbes in the drain trap die and cannot rise to the sink. This apparatus requires a relatively large electric capacity because the heat is transferred not only to the water in the drain trap but also deep into the thick-walled piping. Such a heater requires expensive temperature regulating controls and, therefore, is not economical. Thermostat controls may also be dangerous in such a location because inflammable gases develop therein and may catch fire, for instance from a spark. Also, since such a heater is positioned in the water in the drain pipe, it readily evaporates the water and may even dry it up completely, which will cause unpleasant odors to develop.

It is the object of this invention to obviate the above disadvantages and to provide an inexpensive apparatus which is positioned outside the drain pipe, does not require a large electric capacity and is secure against explosions.

This and other objects are accomplished according to the invention with a connecting pipe portion fluid-tightly connecting the outlet pipe of a wash basin to the drain pipe thereof and an electric resisting heating means surrounding the connecting pipe portion. The heating means is adapted to heat the interior of the connecting pipe portion to an elevated temperature sufficiently high to prevent microbes from rising through the connecting pipe portion from the drain pipe into the outlet pipe.

According to one feature of the present invention, an electric power source is pemanently connected to the heating coil of the heating means and delivers a low voltage, such as 12 to 15 V, thereto. If the heating coil is dimensioned to maintain the temperature at about 80° to 100° C, no microbes will rise from the drain pipe.

In accordance with a preferred embodiment, the electric resistance heating means is an annular heater comprising a metal ring mounted between the outlet and drain pipes, an electric resistance heating coil is wound on the metal ring, and thermal insulating means are mounted between the metal ring and the outlet and drain pipes. In this embodiment, a stub pipe leads preferably from the outlet to the drain pipe and is mounted concentrically within the metal ring. The metal ring and the stub pipe define an air space therebetween, and the stub pipe is preferably frusto-conical, with the diameter of the stub pipe adjacent the drain pipe being smaller than the diameter of the drain pipe. In this manner, the water flows from the wash basin through the outlet pipe and the stub pipe into the drain pipe without touching and cooling the surrounding metal ring of the heater. The heater will thus function continuously at full capacity and the flowing water will neither cool the metal ring of the heater nor soil it. Heat loss will be further reduced by the provision of the insulating means between the outlet and drain pipes and the metal ring of the heater.

The single FIGURE of the accompanying drawing shows a preferred embodiment of the invention in longitudinal section.

In the drawing, there is shown outlet pipe 1 leading from a wash basin to drain pipe 6 which may conduct the flowing water to a drain trap (not shown). A connecting pipe portion is fluid-tightly connected between the outlet pipe and the drain pipe. The connecting pipe portion comprises metal ring 2 mounted between flange 9 of the outlet pipe and flange 10 of the drain pipe. An electric resistance heating coil 3 is wound on the metal ring, the ring and the coil constituting an annular heater. Bolts 8 interconnect the mounting flanges for the heater. The flanges may be integral with the adjoining pipes or they may be suitably fastened thereto, for instance by threads. Heat insulating rings 5, 5 are mounted between metallic flanges 9, 10 and metal ring 2. The rings may be of synthetic resin. Resilient packing 7 is provided between the outlet pipe and the connecting pipe portion.

In the preferred embodiment illustrated herein, an extension of outlet pipe 1 of the wash basin is constituted by stub pipe 4 which is fluid-tightly attached to the outlet pipe and leads therefrom to drain pipe 6, the stub pipe being concentrically mounted within metal ring 2 and defining air space 11 therebetween. The stub pipe is frusto-conical and narrows towards the drain pipe, the diameter of the stub pipe adjacent the drain pipe being smaller than the diameter of the drain pipe. In this way, the water is conducted from the outlet pipe into the drain pipe by stub pipe 4 without the rapidly flowing water splashing against the upper end of drain pipe 6.

While resistance heating coil 3 may be wound directly on the stub pipe and/or no air gap may be left between the metal ring carrying the heating coil and the stub pipe, this would cause greater variations in the temperature and may require special temperature controls.

It will be understood to those skilled in the art that different structures may be devised within the scope of the invention without departing from the spirit thereof, as defined in the appended claims.

We clam:

1. In a wash basin having an outlet pipe and a drain pipe: a connecting pipe portion fluid-tightly connecting the outlet pipe to the drain pipe and comprising a metal ring mounted between the outlet pipe and the drain pipe, an electric resistance heating coil surrounding the connecting pipe portion and wound on the metal ring, the heating coil being adapted to heat the interior of the connecting pipe portion to an elevated temperature sufficiently high to prevent microbes from rising through the connecting pipe portion from the drain pipe into the outlet pipe and thermal insulating means mounted between the metal ring and the outlet and drain pipes for insulating said ring from said outlet pipe and said drain pipe.

2. In the wash basin of claim 1, a stub pipe leading from the outlet pipe to the drain pipe and mounted concentrically within the metal ring.

3. In the wash basin of claim 2, the stub pipe being frusto-conical, the diameter of the stub pipe adjacent the drain pipe being smaller than the diameter of the drain pipe.

4. In the wash basin of claim 2, the metal ring and the stub pipe defining an air space therebetween.

5. In the wash basin of claim 1, an electric power source permanently connected to the heating coil and delivering a low voltage thereto, the heating coil being dimensioned to maintain the temperature of said ring at about 80° to 100° C.

* * * * *